US005671626A

United States Patent [19]

Lonbani

[11] Patent Number: 5,671,626

[45] Date of Patent: Sep. 30, 1997

[54] METHOD OF DRAWING A TUBE

[75] Inventor: Sohrab Sadri Lonbani, Fairborn, Ohio

[73] Assignee: General Motors Corporation, Detroit, Mich.

[21] Appl. No.: 509,371

[22] Filed: Jul. 31, 1995

[51] Int. Cl.[6] ..... B21B 45/02

[52] U.S. Cl. ..... 72/42; 508/469

[58] Field of Search ..... 72/39–42, 46, 72/283, 286, 275, 47; 252/57, 565; 508/469

[56] References Cited

U.S. PATENT DOCUMENTS

| | | | |
|---|---|---|---|
| 3,899,625 | 8/1975 | Izumi et al. | 72/46 |
| 4,411,145 | 10/1983 | Lewis et al. | 72/42 |
| 4,465,710 | 8/1984 | Uchiyama et al. | 72/46 |
| 4,522,733 | 6/1985 | Jonnes | 72/42 |
| 4,745,787 | 5/1988 | Sansome et al. | 72/41 |
| 4,906,751 | 3/1990 | Schneider | 252/57 |
| 5,354,486 | 10/1994 | Evans | 252/57 |
| 5,360,649 | 11/1994 | Sato et al. | 72/46 |
| 5,523,007 | 6/1996 | Kristen et al. | 252/57 |

OTHER PUBLICATIONS

Technical Information & Applications—Product Compliance/Regulatory Information; S.C. Johnson & Son Inc., Racine, Wisconsin 534035011—1993 & 1995.

Metals Handbook Ninth Edition, vol. 14, "Forming and Forging," p. 332.

*Primary Examiner*—Lowell A. Larson
*Assistant Examiner*—Rodney Butler
*Attorney, Agent, or Firm*—Cary W. Brooks

[57] ABSTRACT

The invention includes a method of drawing a tube to reduce its size. The tube is coated with a drawing polymer that includes a styrene acrylate copolymer, a stearate such as ammonium stearate, water, and other additives to enhance lubricity. The tube can be coated at low temperatures such as ambient or from 50°–100° F.

3 Claims, 2 Drawing Sheets

METHOD OF DRAWING A TUBE

FIELD OF THE INVENTION

This invention relates to methods of drawing tubes to reduce their size.

BACKGROUND

There are a variety of methods of preparing a tube for drawing to reduce its size. Most of these methods are performed at high temperatures of 180° F. or above. Further, their methods utilize a variety of steps such as alkaline cleaning, hot-water rinses, acid pickling, phosphating and neutralizing. The high cost associated with these high temperature drawing processes and their numerous process steps is a significant disadvantage.

The present invention provides advantages over the prior art.

SUMMARY OF THE INVENTION

The invention includes a method to prepare a tube for drawing to reduce its size. The tube is coated with a drawing solution that includes a styrene acrylate copolymer, a stearate such as ammonium stearate, and water. The tube is coated at low temperatures such as ambient or from 50°–100° F. The process can be conducted without the use of many steps of the prior art and at most may only require a mild alkaline cleaning step followed by a water rinse. The process eliminates numerous steps of the prior art and can be conducted at ambient temperatures which reduces the cost associated with the steam used for the high temperature preparation and drawing processes of the prior art.

These and other objects, features, and advantages will become apparent from the following brief description of the drawing, detailed description and appended claims and drawings.

DETAILED DESCRIPTION

Figure 1:
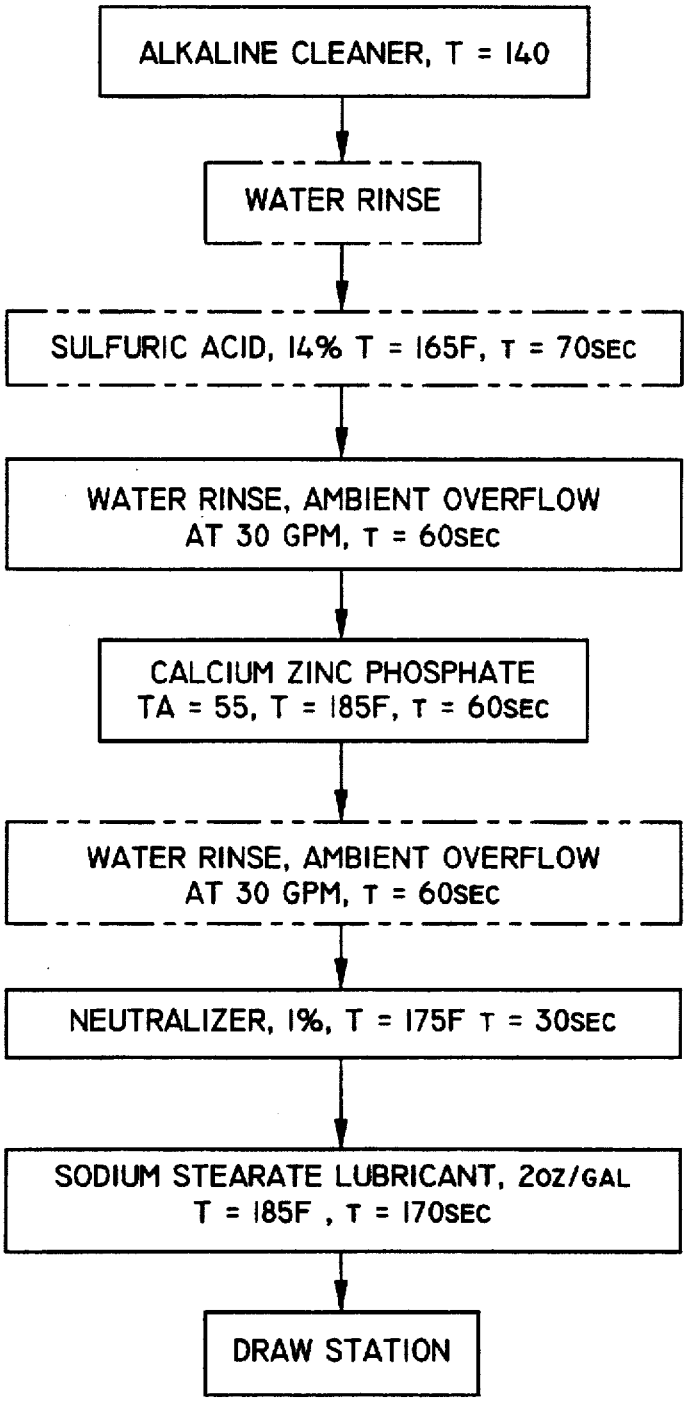
PRIOR ART FIG. 1
FIGS. 1 is a schematic illustration of the high temperature tube preparation and drawing process of the prior art.

The present invention is a method of drawing a tube to reduce its size in the range of about 10% to about 40%. Such tubes may be used for a variety of applications including making tubes for automotive and truck vehicle shock absorbers. The tubes may be made out of a variety of materials such as steel, copper, aluminum and the like. The tubes may be annealed if desirable and thereafter a drawing polymer solution is applied to the tubes. The drawing polymer solution may be applied by a variety of methods such as spraying, brushing, but preferably is applied by dipping so that both the outer and inner tube surfaces are coated with the drawing polymer solution.

The drawing polymer solution includes a styrene acrylate copolymer, a stearate such as ammonium stearate, water, and other additives to enhance lubricity. The polymer drawing solution may also include $C_{7-11}$ alcohols and organic phosphate compounds. A suitable drawing polymer solution can be prepared utilizing an acrylate polymer available from S. C. Johnson & Son, Inc., Racine, Wis. under the trade name, JONCRYL® 537. Preferably, the drawing polymer solution includes about 70 to about 75 weight percent water, about 4 to about 9 weight percent styrene acrylate copolymers, about 5 to about 10 weight percent ammonium stearate and about 1 to about 5 weight percent alcohol and about 0.1 to about 1 weight percent poly(oxy-1,2-ethanediyl)α-phenyl-w-hydroxyphosphate and other additive to enhance lubricity.

Figure 2:
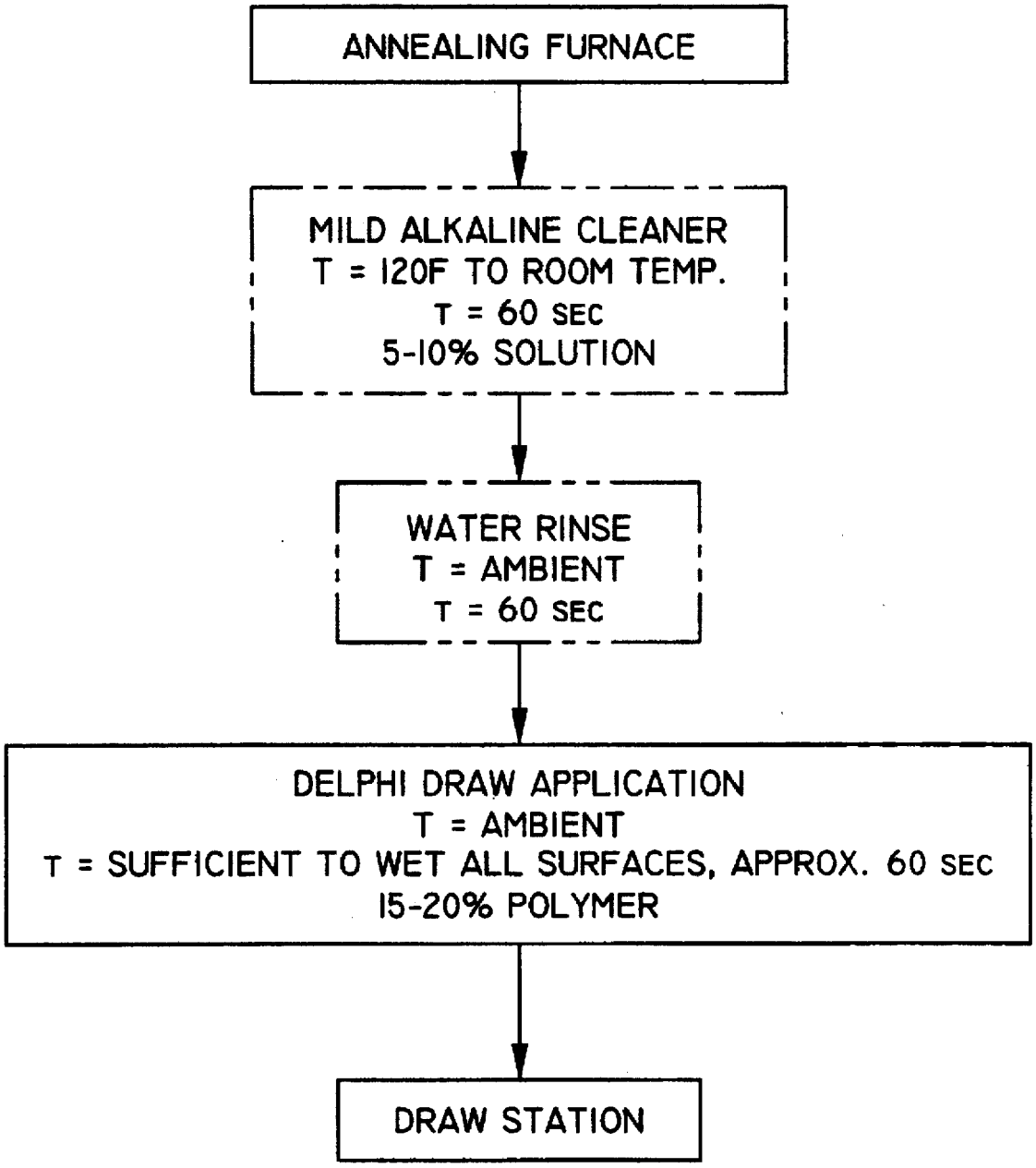
FIG. 2 is a schematic illustration of the low temperature tube preparation and drawing process of the present invention.

After the tubes have been dipped in a solution containing about 15% to about 25% by volume polymer mixture (balance water), then are allowed to air dry. The coating as applied to the tube has a coating weight of about 200 mg/sq. ft. to about 300 mg/sq. ft. The tube is then clamped in a die having a specific outer diameter and inner diameter smaller than the tube size. The coated tube is drawn through the die to reduce the size of the tube. The tubes can be coated at ambient temperatures or a temperature ranging from 50°–100° F. Using the above-described drawing polymer solution, there is no need to prepare the tubes at temperatures of 180° F. and above as is required by the prior art process illustrated in FIG. 1. After the drawing process, the coating can be removed by an alkaline cleaner such as Dart-433 available from Madison Chemicals, Madison, Ind. The present invention illustrated in FIG. 2 greatly reduces the number of process steps for drawing tubes and also eliminates the costs associated with high temperature tube preparation and drawing processes of the prior art.

Tests were run wherein about 1.44" ID×1.5" OD×20 feet long tubes were coated with 1) zinc stearate; or 2) Drawcoat-3000 from Novamax company and drawn through a 1.2 ID×1.38 OD die at a drawing force of 8500 lb./tube. In each case the tube preparation had to be conducted at a temperature of 180° F. However, when the same test was run for a tube coated according to the present invention, the tube could be drawn without damage to the tube.

What is claimed is:

1. A method of drawing a metal tube to reduce its size comprising the steps of:

applying a drawing polymer solution to the outer and inner surfaces of a metal tube at temperatures ranging from 50°–100° F., said polymer drawing solution comprises a styrene acrylate copolymer and a stearate, said step of applying a drawing polymer solution being conducted without prior pickling or phosphating of the metal tube;

drawing the coated metal tube through a die to reduce the size of the tube in the range of about 10% to about 40% reduction in area wherein said drawing polymer solution comprises 70–75 weight percent water, 4–9 weight percent styrene acrylate copolymer, and 5–10 weight percent of ammonium stearate.

2. A method as set forth in claim 1 wherein said step of applying a drawing polymer solution to the inner and outer surfaces of a metal tube is accomplished by dipping said tube in a bath of said drawing polymer solution.

3. A method as set forth in claim 1 further comprising the step of removing the drawing solution after drawing the metal tube.

* * * * *